United States Patent [19]

Mueller

[11] 4,390,144

[45] Jun. 28, 1983

[54] YARN CARRIER

[75] Inventor: Rolf J. Mueller, Greenville, S.C.

[73] Assignee: Textube Corporation, Greer, S.C.

[21] Appl. No.: 230,898

[22] Filed: Feb. 2, 1981

[51] Int. Cl.[3] ..... B65H 75/10; B65H 75/26

[52] U.S. Cl. ..... 242/118.3; 242/118.32

[58] Field of Search ..... 242/118.3, 118.31, 118.32

[56] References Cited

U.S. PATENT DOCUMENTS

| | | | |
|---|---|---|---|
| 2,273,373 | 2/1942 | Perry | 242/118.32 |
| 3,034,743 | 5/1962 | Hill | 242/118.32 |
| 3,138,345 | 6/1964 | Luber | 242/118.3 X |
| 3,141,631 | 7/1964 | Krebs | 242/118.3 |
| 3,450,370 | 6/1969 | Hawkins | 242/118.32 |
| 3,752,414 | 8/1973 | Urquhart | 242/118.32 |
| 3,900,168 | 8/1975 | Hamilton | 242/118.32 |

FOREIGN PATENT DOCUMENTS

| | | | |
|---|---|---|---|
| 778375 | 7/1957 | United Kingdom | 242/118.3 |

*Primary Examiner*—Stanley N. Gilreath

*Attorney, Agent, or Firm*—Wellington M. Manning, Jr.; Luke J. Wilburn, Jr.

[57] ABSTRACT

A yarn carrier having an improved surface for having a yarn package wound thereon. The improved surface for the yarn carrier is provided by a plurality of separate, interrelated projections that combine to receive a proper yarn package without entrapment of yarn between projections and while avoiding sloughing of yarn from the carrier.

11 Claims, 8 Drawing Figures

YARN CARRIER

BACKGROUND OF THE INVENTION

Yarn carriers, such as cones, pirns, tubes, and the like of wide and varied design and size have heretofore been used by the textile industry for the production of yarn packages therearound. Depending upon the particular yarn handling process in which the carrier is to be utilized, prior art carriers have assumed various shapes as alluded to above, exemplified by cylinders, frustums, and the like. Prior art carriers have generally been manufactured by molding same of paper or polymeric material, or by spiral wrapping of paper into a tube.

In the production of a yarn package around a carrier, the carrier is located on a yarn handling machine where a strand of yarn is wound around the package in a predetermined fashion. In general, the strand is pulled onto the package due to rotation of the package by a driven spindle or other means, with the yarn being properly located along the length of the carrier by a traverse mechanism which reverses at the end of the carrier and thus applies a proper strand wind around the carrier. It is of course very important that once received around the carrier, the yarn remain in the position in which it was placed during winding, and that during subsequent unwinding, the yarn be removed in proper order and fashion. Such is particularly important during initial stages of production of the yarn package around the carrier since a misaligned strand at that point could well be detrimental to the quality and thus functionality of the overall package.

In order to prepare carrier surfaces for proper receipt of a yarn as a package is being produced, various techniques have been employed to roughen or otherwise condition the surface of the carrier for receipt of the strand of yarn. In so preparing a carrier surface, it is an important consideration that a strand wound thereon not become entrapped or otherwise entangled at the surface which could interfere with proper unwinding of the strand. Also as mentioned above, the strand should remain in place and not slough off the carrier. Since of course various sizes and types of yarns may be wound around like carriers, the particular surface employed for proper package preparation should likewise be suitable for the different yarns. In general such has not been available for the carriers molded from polymeric materials.

In preparing surfaces of yarn carriers for proper package production, several techniques have been employed. Paper carriers, for example, may be manufactured from sheet goods that bear distinct forming fabric indentations, or the like which afford a discontinuous surface along the carrier. This surface is generally suitable for the full spectrum of yarn. Molded plastic or polymeric carriers have been sandblasted or otherwise abraded to roughen the particular part of the carrier surface to receive the yarn. Further, designs had been incorporated in the mold in which the carriers are produced, such that a roughened surface is produced in situ as the carrier is molded. Molding is generally the technique employed according to techniques of the present invention. The present invention, however, overcomes the disadvantages of the prior art, in that, a carrier surface is now provided around which generally all yarns may suitably be wrapped to provide precision wound packages, and which permits high speed yarn transfer from the package at speeds of 1,200 or more yards per minute. Such capability is not available in the prior art molded polymeric carriers. However, there is no known prior art that is believed to anticipate or suggest the present invention.

SUMMARY OF THE INVENTION

It is an object of the present invention to provide an improved yarn carrier.

Another object of the present invention is to provide an improved yarn carrier that is molded of a thermoplastic polymeric material.

Still further, another object of the present invention is to provide an improved yarn carrier which is provided with a particular surface along a major portion of the length of same about which a yarn package may be produced.

Yet another object of the present invention is to provide a yarn carrier with a yarn contacting surface that is universal from the standpoint of being able to suitably receive fine yarns and coarse yarns therearound without sloughing of the yarn.

Generally speaking, the present invention comprises an elongated body, said body defining an inside wall surface and an outside wall surface, said carrier being receivable on a yarn handling machine where a yarn package may be produced about said carrier body, at least a portion of said outside wall surface having a yarn receiving and holding area therealong, said area being defined by a plurality of separated, interrelated projections that combine to receive a yarn wound therearound while precluding entrapment of the yarn between individual projections and precluding sloughing of the yarn from the carrier.

More specifically, the improved yarn carrier of the present invention includes a surface definition along at least a majority of the length of the outside wall of the body of the carrier where a plurality of separate but interrelated projections are provided in overlapping fashion, following a helical path such that entrapment of the yarn between the individual projections is precluded while at the same time, the surface is of adequate roughness to preclude sloughing of the yarn therefrom. As mentioned hereinbefore, the particular surface is universally acceptable to generally all yarns from very fine to very coarse, which was not available on prior art carriers.

In a most preferred arrangement, the projections that are provided along the outer wall surface of the yarn carrier, are made up of a progression of groupings of projections. In each group, a first long projection is followed by two short projections. Repeat of this progression around the circumference of the carrier, along the helical path provides the surface of the present invention, which takes the general aesthetic appearance of a series of parabolic figures.

In producing the projections around the outer surface of the yarn carrier of the present invention, preferably the reverse of the projections is produced in a mold in which the carrier are to be produced. Specifically, a knurling tool is preferably brought into contact with the mold surface and produces the mirror image of the surface projections. In following the helical path overlap between adjacent projections is produced which assists in precluding entrapment or entanglement of yarn in contact therewith.

DESCRIPTION OF THE PREFERRED EMBODIMENTS

Figure 4:
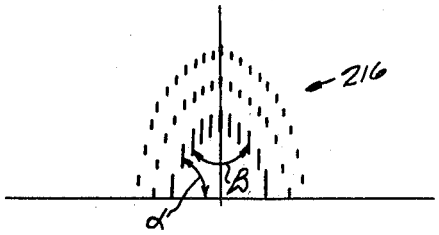
FIG. 4 is a schematic presentation of a parabolic design as produced by the surface of the present invention.

Referring to the Figures, preferred embodiments of the present invention will now be described in detail. As illustrated in the Figures, a conically shaped yarn carrier and a cylindrically shaped yarn carrier are illustrated, both of which will have the surface according to the present invention with a preferred embodiment of same being illustrated in FIGS. 4, 5 and 6.

Figure 1:
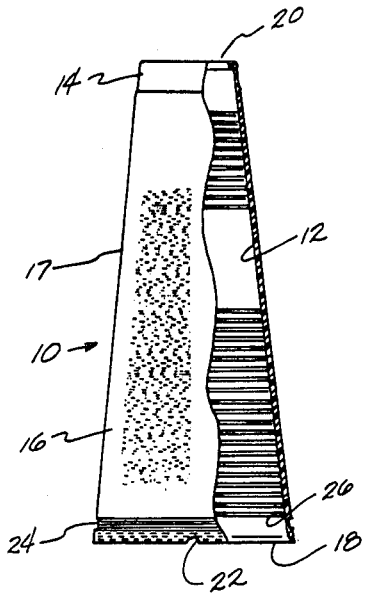
FIG. 1 is an elevational view of a frusto conical yarn carrier according to teachings of the present invention, shown partially in cross section with surface characteristics enlarged for clarity.
Figure 2:
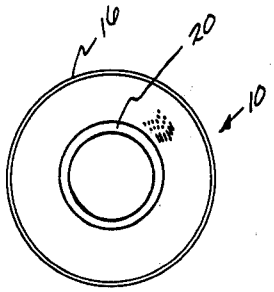
FIG. 2 is a top plan view of a yarn carrier of the type illustrated in FIG. 1.

In FIG. 1, a cone which generally is a frusto conical body generally indicated as 10 is illustrated in partial cross section. Conical body 10 has an inside wall surface 12 and an outside wall surface 14, along which a particular yarn receiving and holding surface 16 is presented. Surface 16 is enlarged on the Figures to better enable one skilled in the art to understand same. Yarn receiving and holding surface 16 is located along at least a majority of the length of the carrier body 10 and has a peripheral definition such that a strand being wound therearound on a yarn handling machine will remain where positioned during winding and will not slough off the carrier, and secondly, during the unwinding operation, the yarn will be freely removable from the carrier without entrapment or other retention of same along the specifically defined surface. In general a lower end 18 of body 10 is receivable over a portion of a yarn handling machine and is provided with a generally roughened outer surface for improved yarn placement thereabout. Engagement with the portion of the yarn handling machine is further maintained by a plurality of concentric ribs 26 that project from the inside wall surface 12 of body 10. Furthermore, a notch 22 or other means may be provided at the lower end 18 of carrier body 10 to receive a strand during initiation of the winding operation where the strand first is wrapped around a portion 24 of the cone 10 adjacent the winding surface 16 for the production and storage of a yarn transfer tail. Thereafter winding will continue along the improved surface 16 where the package will be produced.

Figure 3:
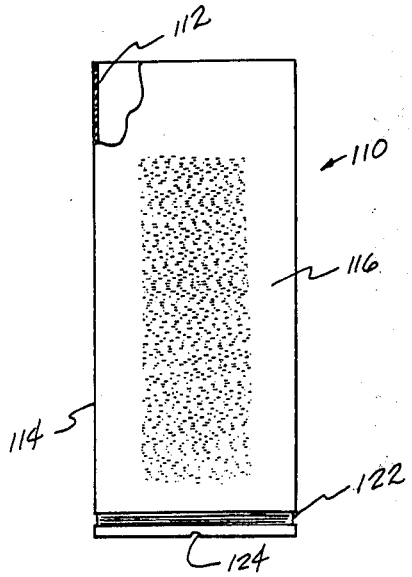
FIG. 3 is an elevational view of a cylindrical yarn carrier according to teachings of the present invention with surface characteristics enlarged for clarity.

In FIG. 3, a cylindrical carrier 110 is illustrated having an interior wall surface 112 and an exterior wall surface 114 along which a specifically defined yarn receiving and holding surface 116 is located (illustrated enlarged for purposes of clarity). Tube 110 likewise has a yarn transfer tail storage area 122 and a notch or other means 124 for initiating the wind therearound.

Figure 5:
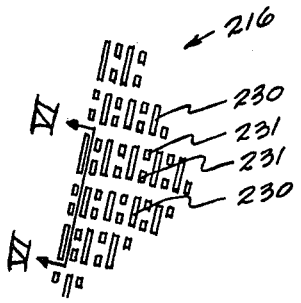
FIG. 5 is an exploded, enlarged view of a portion of the improved surface as provided on the carriers of FIGS. 1-3 without consideration for orientation of same with respect to the carrier.
Figure 6:
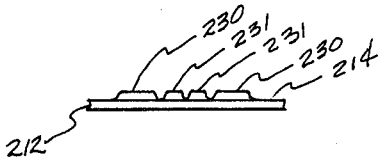
FIG. 6 is a cross sectional view taken along a line VI—VI of FIG. 5 to illustrate in greater detail the projections that produce the carrier surface according to the present invention.

Making specific reference to FIGS. 1 through 6, the surface along which the yarn is wound and where the yarn is held will be defined according to a preferred embodiment of the invention. Making particular reference to FIGS. 4, 5 and 6, a portion of a carrier surface 216 is illustrated having the plurality of projections therealong. While FIGS. 5 and 6 illustrate the projections that cooperate to define the carrier surface 216, same are not intended to depict any particular orientation of the projections 230 and 231 with respect to the carrier body. According to a preferred embodiment of the invention, the projections follow a repeating progression of a long section 230, followed by two short sections 231. With such being repeated continuously around the perimeter of the carrier, while following a helical path such that the projections overlap, yarn entrapment does not occur between the individual projections. In a preferred arrangement for a carrier of the type illustrated in FIG. 1, the molded projections define a plurality of parabolic structures where the average base inside angle of the parabolas is in a range of from about 65 to 70 degrees (angle $\alpha$ in FIG. 4) and the average angle of the apex of the parabolas is in a range of from about 60 to 100 degrees (angle $\beta$ in FIG. 4). The angle of the parabolic figures of course depends on the angle of the helical path along which the projections are located. Further, in a preferred arrangement, the long projections have a length of approximately 3 millimeters while the short projections have a length of approximately 0.8 millimeter in length.

Figure 7:
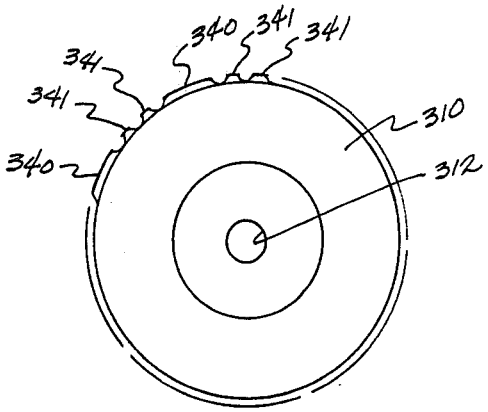
FIG. 7 is a side elevational view of a knurling tool that may be used to produce the indentation in the mold cavity that will form the carrier surface of the present invention.
Figure 8:
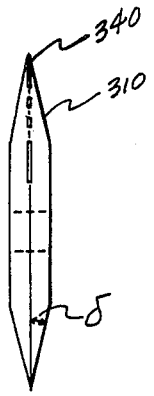
FIG. 8 is a frontal view of the knurling tool as illustrated in FIG. 7.

In manufacture of the carrier according to teachings of the present invention, a knurling tool such as illustrated in FIGS. 7 and 8 may be utilized to produce mirror image depressions of the projections around the mold surface. Knurling tool 310 is thus illustrated having a pointed outer periphery along which progressions of one long projection 340 followed by two short projections 341 proceed therearound. A preferred knurling tool for providing cavities for molding of the projections is shaped to an angle $\delta$ of about 30 degrees (FIG. 8). Twelve short segments 341 (0.8 millimeter) and six long segments 340 (3.0 millimeters) are provided around the circumference of the tool, in the order of progression mentioned above. Knurling tool 310 is thus set on a particularly selected helical angle and is rolled around the concavity of the mold to provide the mirror image depressions of later molded projections 230 and 231 therein.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. An improved yarn carrier, said carrier comprising an elongated body, said body defining an inside wall surface and an outside wall surface, said carrier being receivable on a yarn handling machine where a yarn package may be produced about said carrier body, at least a major portion of said outside wall surface having a yarn receiving and holding area therealong, said area being defined by a plurality of separated, interrelated projections that follow a helical path about said body and cooperate to produce a predetermined uninterrupted design along said area, said design including a plurality of rows of parabolic figures extending around said body whereby a yarn may be wound therearound while precluding entrapment of the yarn between individual projections and precluding sloughing of the yarn from the carrier.

2. A carrier as defined in claim 1 wherein the body is molded of a thermoplastic polymeric material.

3. A carrier as defined in claim 2 wherein said body is frustoconical in shape.

4. A carrier as defined in claim 2 wherein said body is cylindrical in shape.

5. A carrier as defined in claim 2 wherein said outside wall surface of said body further has a yarn transfer tail storage area adjacent said yarn receiving and holding area.

6. A carrier as defined in claim 5 wherein said body is notched at an end of same.

7. A carrier as defined in claim 3 wherein said inside wall surface of said body is provided with a plurality of ringed projections extending therefrom.

8. A carrier as defined in claim 3 wherein said body adjacent a lower end of same has a roughened surface therearound.

9. A carrier as defined in claim 1 wherein certain of the projections are of different lengths and follow a long length, short length, short length repeating projection pattern.

10. An improved yarn carrier, said carrier comprising a thermoplastic molded, generally conically shaped body, said body defining an inside wall surface and an outside yarn receiving wall surface, said outside yarn receiving wall surface having a plurality of separate, interrelated projections that follow a helical path about said body and cooperate to produce a predetermined uninterrupted design along said area, said design including a plurality of rows of parabolic figures extending around said body such that yarn being wound around said surface will not become entrapped between the projections and will not slough off the carrier.

11. A carrier as defined in claim 10 wherein certain of said projections are of different lengths and include repeat progressions of a long projection and two short projections.

* * * * *